US005409207A

United States Patent [19]

Freeman

[11] Patent Number: 5,409,207

[45] Date of Patent: Apr. 25, 1995

[54] STACKING OF FLEXIBLE PLANAR ARTICLES

[75] Inventor: Ross A. Freeman, Somersworth, N.H.

[73] Assignee: Moore Business Forms, Inc., Grand Island, N.Y.

[21] Appl. No.: 92,412

[22] Filed: Jul. 16, 1993

[51] Int. Cl.[6] ..... B65H 29/44

[52] U.S. Cl. ..... 271/181; 271/185; 271/212; 271/215

[58] Field of Search ..... 271/184, 185, 212, 215, 271/216, 177, 180, 181; 414/798.5, 798.2

[56] References Cited

U.S. PATENT DOCUMENTS

| | | | |
|---|---|---|---|
| 2,392,746 | 1/1946 | Labombarde . | |
| 2,815,210 | 12/1957 | Weber et al. . | |
| 2,933,313 | 4/1960 | Stobb . | |
| 3,591,171 | 7/1971 | Schmidt . | |
| 3,831,784 | 8/1974 | Newell | 271/177 X |
| 3,883,131 | 5/1975 | Anderson, Jr. et al. . | |
| 3,945,635 | 3/1976 | Marin . | |
| 4,034,845 | 7/1977 | Honegger . | |
| 4,054,283 | 10/1977 | Rayfield . | |
| 4,102,531 | 7/1978 | Jiminez . | |
| 4,131,272 | 12/1978 | Hartnig . | |
| 4,200,016 | 4/1980 | Helmig et al. . | |
| 4,245,832 | 1/1981 | Klenk et al. . | |
| 4,361,318 | 11/1982 | Stobb . | |
| 4,451,031 | 5/1984 | McCain et al. . | |
| 4,463,940 | 8/1984 | Mock . | |
| 4,500,245 | 2/1985 | Madewell | 271/177 X |
| 4,509,739 | 4/1985 | Kurokawa | 271/215 X |
| 4,657,237 | 4/1987 | Hansch . | |
| 5,061,233 | 10/1991 | Schultz et al. . | |
| 5,064,185 | 11/1991 | Ricciardi | 271/215 X |
| 5,082,273 | 1/1992 | Matsumoto | 271/215 |

FOREIGN PATENT DOCUMENTS 340494 4/1989 European Pat. Off. .

*Primary Examiner*—David H. Bollinger
*Attorney, Agent, or Firm*—Nixon & Vanderhye

[57] ABSTRACT

Short multi-ply business forms, or other flexible planar articles, are stacked with a vertical orientation in a horizontally elongated stack. The forms are conveyed in a first horizontal direction, then deflected by a deflecting roller and conveyor belts to move toward a generally vertical orientation, and driven vertically into contact with a depth stop, so that they have a vertical orientation and the first form in a stack is against a backstop. The backstop is moved intermittently in the horizontal first direction to accommodate further forms in the stack. A conveyor for moving the forms vertically is mounted for pivotal movement about a generally horizontal axis, which movement is sensed by a sensor which in turn, through a controller and motor, effects intermittent movement of the backstop. The depth stop may be adjusted to accommodate forms of different depths, and the position of the horizontal axis about which the second conveyor pivots may also be adjusted. The pivoting vertical conveyor applies a packing force against the forms in the stack, and its center of gravity is between its pivot axis and the stack at all times.

31 Claims, 6 Drawing Sheets

Fig. 1
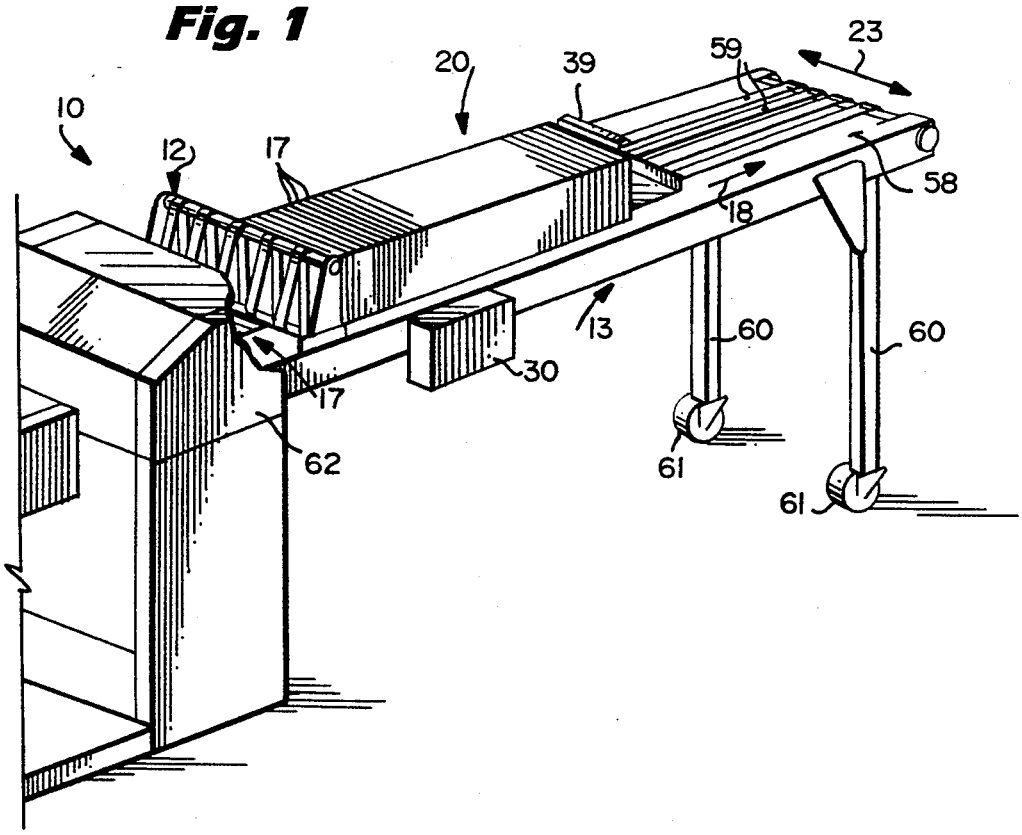
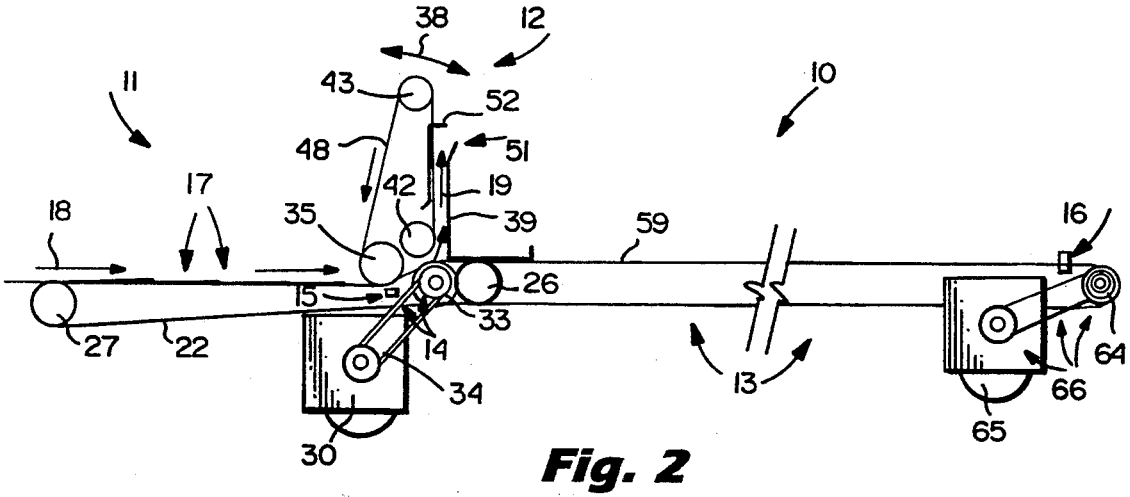
Fig. 2

STACKING OF FLEXIBLE PLANAR ARTICLES

BACKGROUND AND SUMMARY OF THE INVENTION

There are many situations in which it is desirable to stack articles, such as business forms, so that they have a vertical orientation, the stack itself being deployed horizontally. This is typically done by conveying the articles, such as shingled signatures, business forms, or individual flexible sheets so that they move horizontally, and then are deflected by a roller, conveyor belt, and/or the like, to move vertically, and then are placed in a stack against a backstop. Typically, the backstop either slides along a horizontal surface, such as shown in U.S. Pat. No. 4,245,832, or is driven (along with a conveyor belt supporting the articles) horizontally continuously at a slow speed allowing the stack to increase in size, such as shown in U.S. Pat. No. 4,361,318. Alternatively, the backstop can be mounted for movement against the bias of a counter-weight, so that as the articles are fed to the stack and the stack size increases, the backstop automatically moves to accommodate that increase against the bias of the counter-weight, as shown in U.S. Pat. No. 3,591,171.

While prior art systems and procedures have allowed effective stacking of numerous types of articles in vertical stacks, there are some articles that have been difficult to effectively stack in this manner. Typically, short, multi-ply business forms (i.e., having a depth of about 3 to 6 inches) have been very difficult to effectively stack in a vertical style high-capacity stacker. As the stack height increases, such forms tend to become "tippy" and tend to fall over or jam, which is not a problem with larger sheets. Prior art systems for horizontally stacking such forms, such as described above, are also not optimum, especially for short, multi-ply business forms.

According to the present invention, a method and apparatus are provided which overcome the problems discussed above with the attempted vertical stacking of short, multi-ply business forms. Also, according to the method and apparatus of the invention, a simple, compact structure, which provides an effective packing force against the forms or like articles when provided in a vertical orientation in a horizontally elongated stack, are provided allowing effective, efficient, and compact stacking of multi-ply business forms or like articles.

According to one aspect of the present invention, a particular conveyor is provided which is utilized in a stacking apparatus according to the invention. The unique conveyor, per se, conveys multi-ply business forms or the like from a generally horizontal orientation to a generally vertical orientation. The conveyor comprises the following elements: A driver roller rotatable about a third axis defined by a shaft. First and second idler rollers rotatable about first and second axes, respectively. First and second generally vertically extending side plates mounting the first through third axes so that they are essentially fixed with respect to each other and are generally horizontal, and so that the idler rollers are both horizontally spaced from the driver roller in a first horizontal direction, and so that the idler rollers are both vertically above the driver roller. Means for mounting the drive roller shaft so that the side plates are pivotal about the third axis. And, at least one conveyor belt extending around the drive roller and first and second idler rollers for engaging business forms and effecting conveyance thereof.

The conveyor may also comprise means for adjusting the location of the third axis along the arc of a circle having a center below and spaced from the drive roller in the first horizontal direction. The at least one conveyor belt preferably comprises a plurality of conveyor belts spaced from each other in a second horizontal direction, transverse to the first horizontal direction. Also, there preferably is provided a cross member extending between the side plates, between the idler rollers, at least one adjustable form depth stop having a stop portion thereof extending horizontally away from the conveyor belt between two of the conveyor belts also being provided, as well as means for adjustably mounting the form depth stop to the cross member. A drive gear may be mounted to the drive roller, so that rotation of the drive gear effects rotation of the drive roller and the conveyor belt. Also, the conveyor is constructed so that its center of gravity is spaced from the third axis in the first horizontal direction, and is significantly above the third axis.

According to another aspect of the present invention, a stacking apparatus is provided, which stacking apparatus may utilize the conveyor described above. The stacking apparatus basically comprises the following elements:

First conveying mean for conveying generally planar articles to be stacked in a first, substantially horizontal direction. Deflecting means for deflecting articles conveyed by the first conveying means toward a generally vertical orientation. A backstop for articles disposed in a generally vertical orientation. Second conveying means for conveying articles generally vertically from the deflecting means into the generally vertical orientation in operative association with the backstop. Means for mounting the second conveying means for pivotal movement about a generally horizontal axis. Third conveying means associated with the backstop for moving the backstop, and a generally vertically oriented articles stack in association therewith, away from the second conveying means in the first direction. First sensing means for sensing pivotal movement of the second conveying means about the generally horizontal axis. And, means for effecting intermittent operation of the third conveying means in response to the sensing means sensing pivotal movement of the second conveying means.

An article depth stop may be mounted adjacent the second conveying means for limiting the generally vertical movement of the articles by the second conveying means, as well as means for adjustably mounting the article depth stop so that the depth stop may be adjusted to accommodate articles of different depths. Also, a plurality of infeed nip wheels may be mounted in operative association with the first conveying means, upstream of the second conveying means in the first direction, for properly positioning articles to be conveyed on the first conveying means.

The first conveying means preferably comprises a plurality of first conveyor belts spaced from each other in a second generally horizontal direction, transverse to the first direction, and the deflecting means includes a deflecting roller over which the first conveyor belts pass. The second conveying means comprises a plurality of second conveyor belts spaced from each other in the second direction passing over a drive roller, and first and second idler rollers. The drive roller has a bottom peripheral surface portion vertically below and upstream of (in the first direction) a top peripheral surface of the deflecting roller. The first idler roller has a bottom peripheral surface vertically above the top peripheral surface of the deflecting roller, and the axis of rotation of the first idler roller is slightly downstream of the axis of rotation of the deflecting roller in the first direction. The drive roller of the second conveying means cooperates with the first idler roller, the first conveyor belts and the deflecting roller to form the deflecting means.

The second conveying means drive roller and the deflecting roller may have intermeshing gears associated therewith so the driving of one of them drives the other. The first conveying means may include a first end roller about which the first conveyor belts are wrapped, disposed at roughly the same vertical position as the deflecting roller and downstream thereof in the first direction. The first end roller is positioned so that the first conveyor belts convey articles in the first direction a short distance after they are stacked in the vertical orientation.

The third conveying means comprises a plurality of third conveyor belts spaced from each other in the second direction, the third conveyor belts preferably wrapped about the first end roller in interleaved relationship with the first conveyor belts. The third conveying means also may comprise a generally horizontal table surface over which the third conveyor belts and the backstop pass.

The means for mounting the second conveying means for pivotal movement about a generally horizontal axis may comprise a shaft connected to the drive roller, and bearing means for mounting the shaft so that it defines a generally horizontal axis about which the second conveying means may pivot. The bearing means may include first and second plates spaced from each other in the second direction and mounting all of the drive roller and first and second idler rollers. Means may also be provided for adjusting the position of the pivot point about which the second conveying means pivots, while still retaining the intermeshing of the gears at the second conveying means drive roller and deflecting roller.

Stop means may be provided for limiting the pivotal movement of the second conveying means away from the backstop so that the center of gravity of the second conveying means is always between the generally horizontal pivot axis thereof and the backstop, so that the weight of the second conveying means biases articles being stacked into their vertical orientation, in operative association with the backstop, providing a packing force. The center of gravity may be adjusted by adjusting the position of the pivot point about which the second conveying means pivots. Also, there may be provided second sensing means mounted in association with the third conveying means at a point thereof remote from the second conveying means, the second sensing means senses the position of the backstop and terminates operation of all three conveying means once the backstop reaches a predetermined position remote from the second conveying means.

According to another aspect of the present invention, a method of stacking a plurality of multi-ply business forms extending in a generally vertical orientation, utilizing a backstop capable of generally horizontal movement, is provided. The method comprises the steps of substantially sequentially (a) conveying the multi-ply business forms having a substantially uniform depth of between about 3 to 6 inches, in sequence, in a first generally horizontal direction, the forms each having a leading edge in the first direction; (b) deflecting the forms, in sequence, so that the leading edges thereof move upwardly; (c) substantially simultaneously with, and subsequent to, step (b), driving the forms so that they move upwardly and assume a vertical orientation, the depths thereof extending generally vertically; and (d) substantially simultaneously with, and subsequent to, step (c) stacking the forms in a horizontally elongated stack, the first form in the stack engaging the backstop.

There preferably is also the further step (e), substantially simultaneously with the steps (c) and (d), of applying the bias of a horizontal force component of a weight against the vertically oriented forms (the weight of the second conveying means, pivoting about the generally horizontal pivot point) against the vertically oriented form so as to facilitate packing of the forms in a stack. Also, there preferably is a step (f) of intermittently, in response to the packing force on the stack reaching a predetermined level (that is, pivoting the second pivot means about its pivot axis away from the backstop) moving the backstop in the first direction of distance sufficient to reduce the packing force on the stack (thereby allowing the second conveying means to pivot back to its initial position). There is also the further step (g) of terminating steps (a) through (f) once the stack of forms has reached approximately a predetermined size. Further, there is a step (h) of limiting upward movement of the forms and the practice of step (b). The position to which upward movement of the forms during the practice of step (b) will be limited may be adjusted prior to initiation of the method, and will depend upon the depth of the forms being acted upon.

According to yet another aspect of the present invention, a method of stacking a plurality of planar articles using a backstop movable in a generally horizontal first direction, so that the articles have a generally vertical orientation, is provided. The method comprises the following steps: (a) Conveying the articles, in sequence, in the first direction, each article having a leading edge in the first direction. (b) Deflecting the articles, in sequence, so that the leading edges thereof move vertically upwardly. (c) Substantially simultaneously with, and subsequent to, step (b), conveying the articles vertically upwardly so that they assume a vertical orientation. (d) Substantially simultaneously with step (c), forming the articles into a horizontally elongated stack while they have a vertical orientation. And, (e) substantially simultaneously with steps (b) and (c), applying a horizontal force component of a weight against the articles in the stack so as to facilitate packing of the articles in the stack, the force component of the weight compressing the articles in the stack while the backstop is held stationary.

It is the primary object of the present invention to provide the simple, effective, and efficient stacking of planar articles, such as short, multi-ply business forms, in a vertical orientation in a horizontally elongated stack. This and other objects of the invention will become clear from an inspection of the detailed description of the invention, and from the appended claims.

BRIEF DESCRIPTION OF THE DRAWINGS

FIG. 1 is a front perspective view showing an exemplary apparatus according to the present invention;

FIG. 2 is a side schematic view showing the major operating components of the stacker of FIG. 1;

DETAILED DESCRIPTION OF THE DRAWINGS

Figure 4:
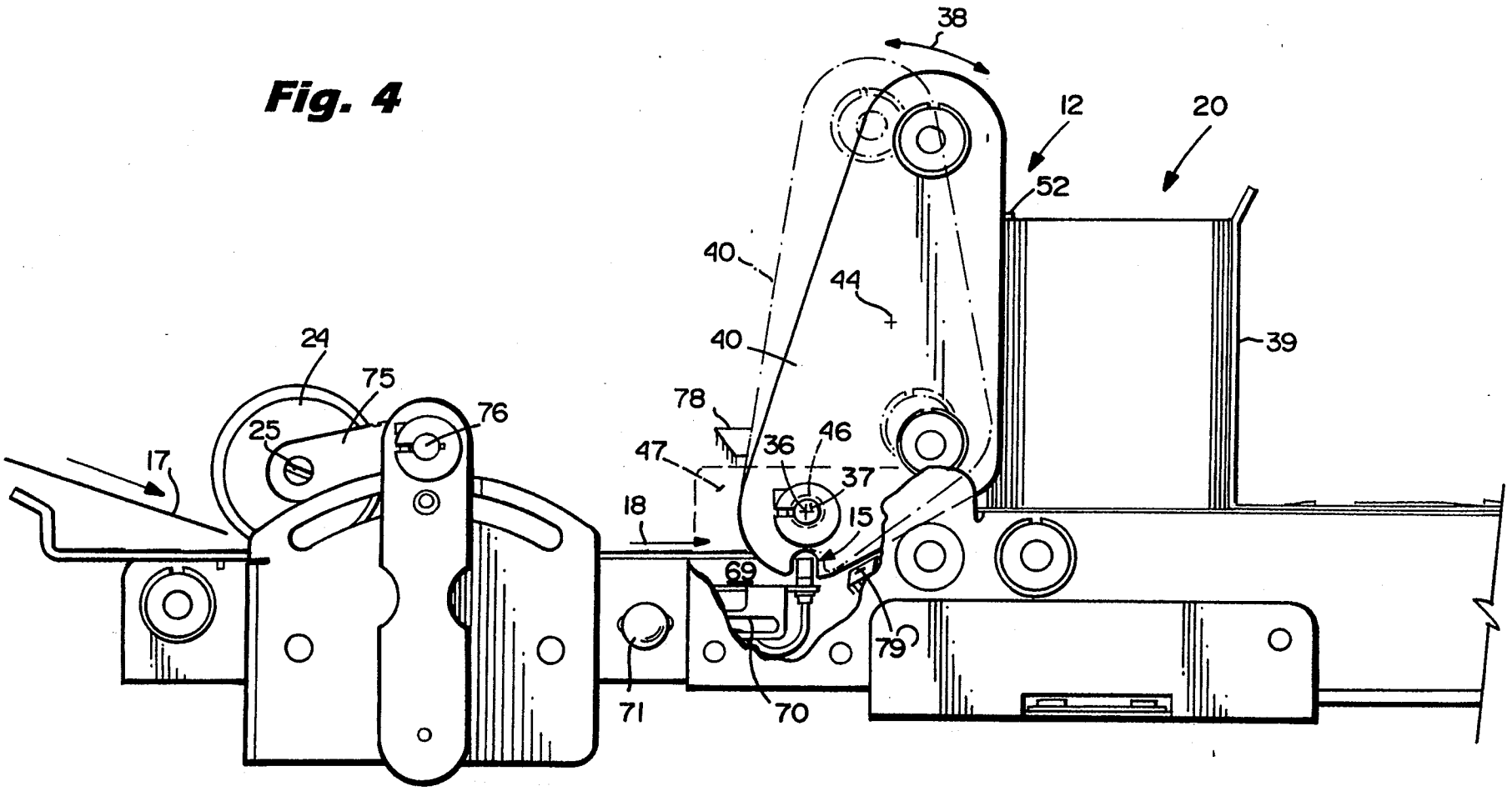
FIG. 4 is a view like that of FIG. 3 only showing the stacking apparatus with supporting frame components thereof, and showing the second conveyor means in a dotted line position (the degree of movement greatly exaggerated for clarity of illustration) to which it may be pivoted during stacking of articles.
Figure 5:
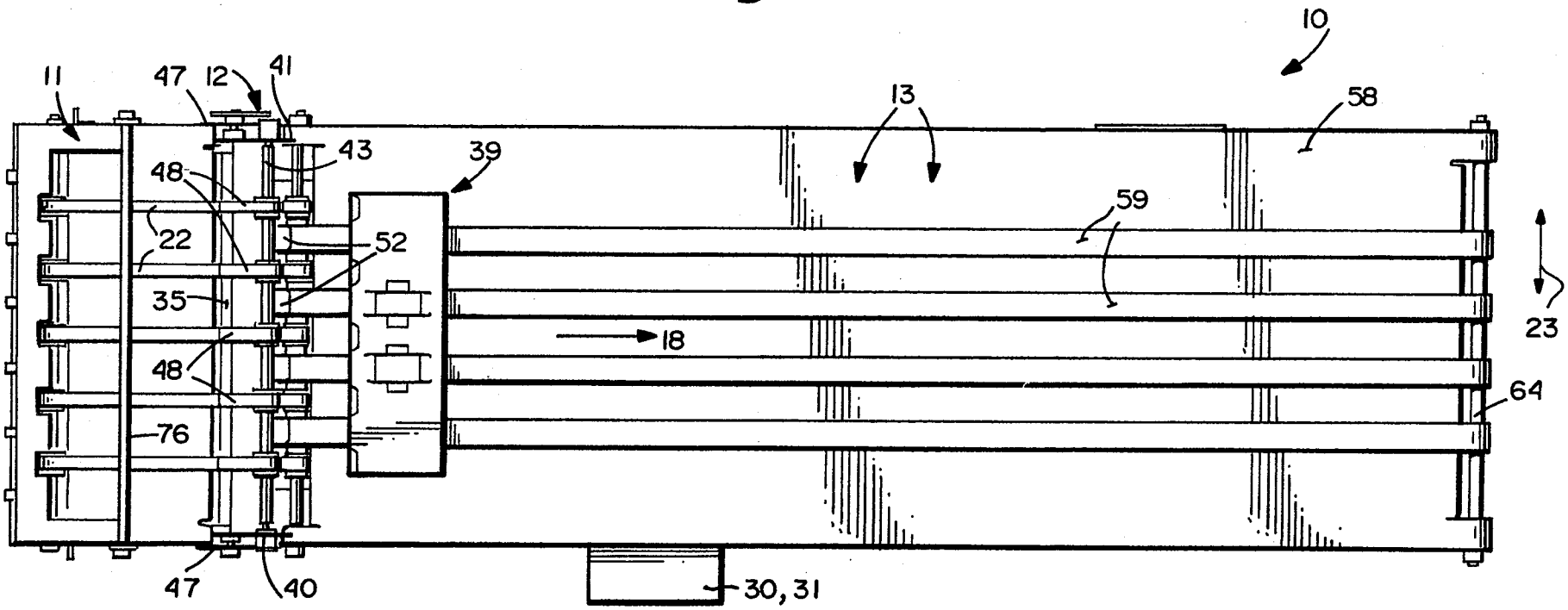
FIG. 5 is a top plan view of the apparatus of FIGS. 1 through 4.

An exemplary stacker according to the present invention is shown generally by reference numeral 10 in FIGS. 1, 2 and 5. The apparatus 10 includes a first conveying means, shown generally by reference numeral 11 in FIG. 2, a second conveying means, shown generally by the numeral 12, and a third conveying means shown generally by reference numeral 13. There also is provided deflecting means, shown generally by reference numeral 14, and first and second sensing means 15, 16. The apparatus 10 is particularly useful for forming a horizontally elongated stack of generally vertically oriented business forms, shown generally by reference numeral 17 in FIGS. 1 and 2, which are initially shingled while being conveyed in a first generally horizontal direction 18 by the first conveying means 11, and which are subsequently conveyed generally vertically as indicated by arrow 19 in FIG. 2 by the second conveying means 12. In the vertical orientation thereof, the forms are in a horizontally elongated stack, shown generally by reference numeral 20 in FIGS. 1, 3 and 4. The invention is particularly suitable for use with multi-ply short business forms, e.g. those having a depth of between about 3–6 inches, although the stacking apparatus 10 may be utilized with a wide variety of planar elements as long as the elements have a configuration which is flexible enough to allow stacking by changing the articles from a generally horizontal orientation to a generally vertical orientation.

Figure 3:
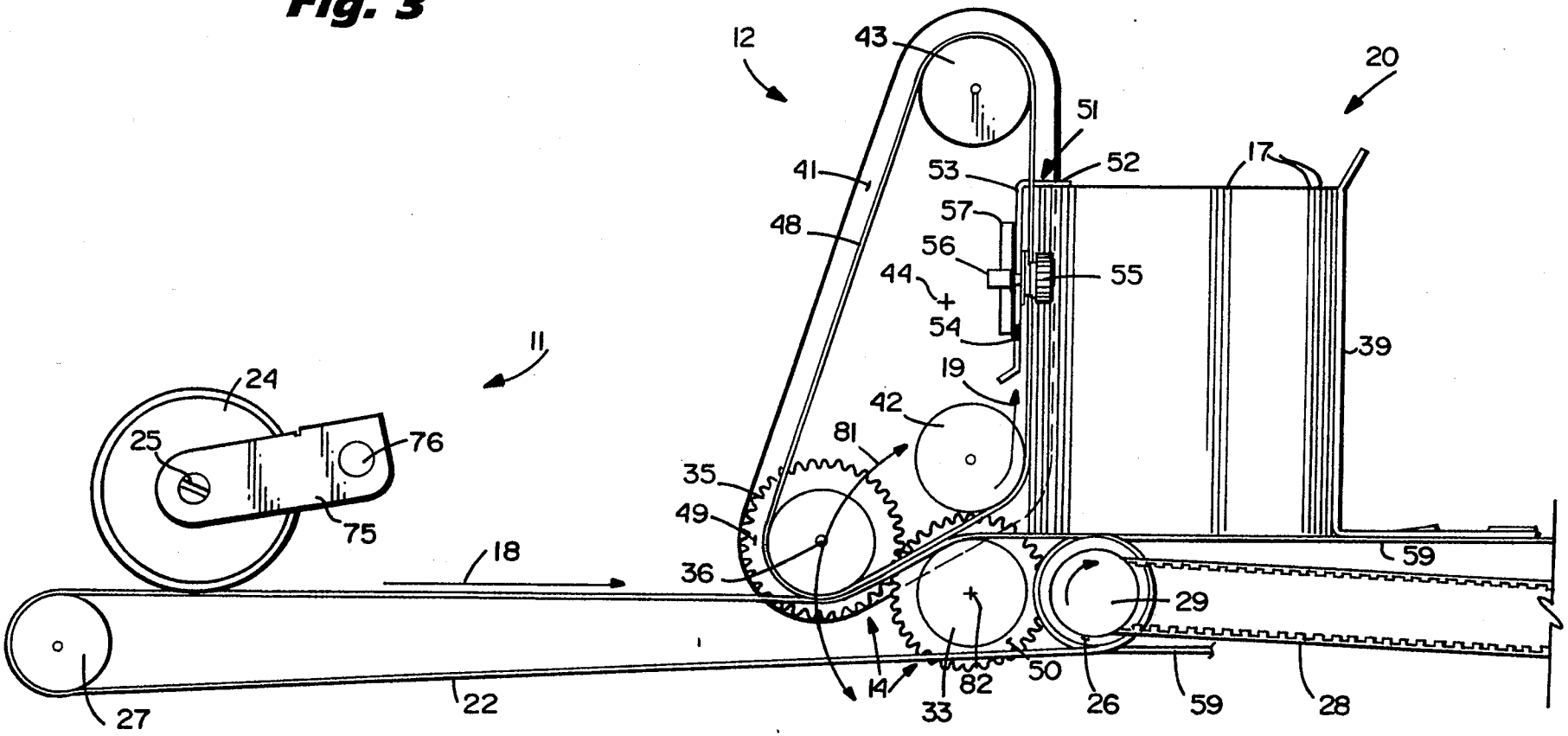
FIG. 3 is a detailed schematic side view, with all of the near frame and support components removed for clarity of illustration, showing the area of movement of the articles being stacked into a vertical orientation of the apparatus of FIGS. 1 and 2.
Figure 6:
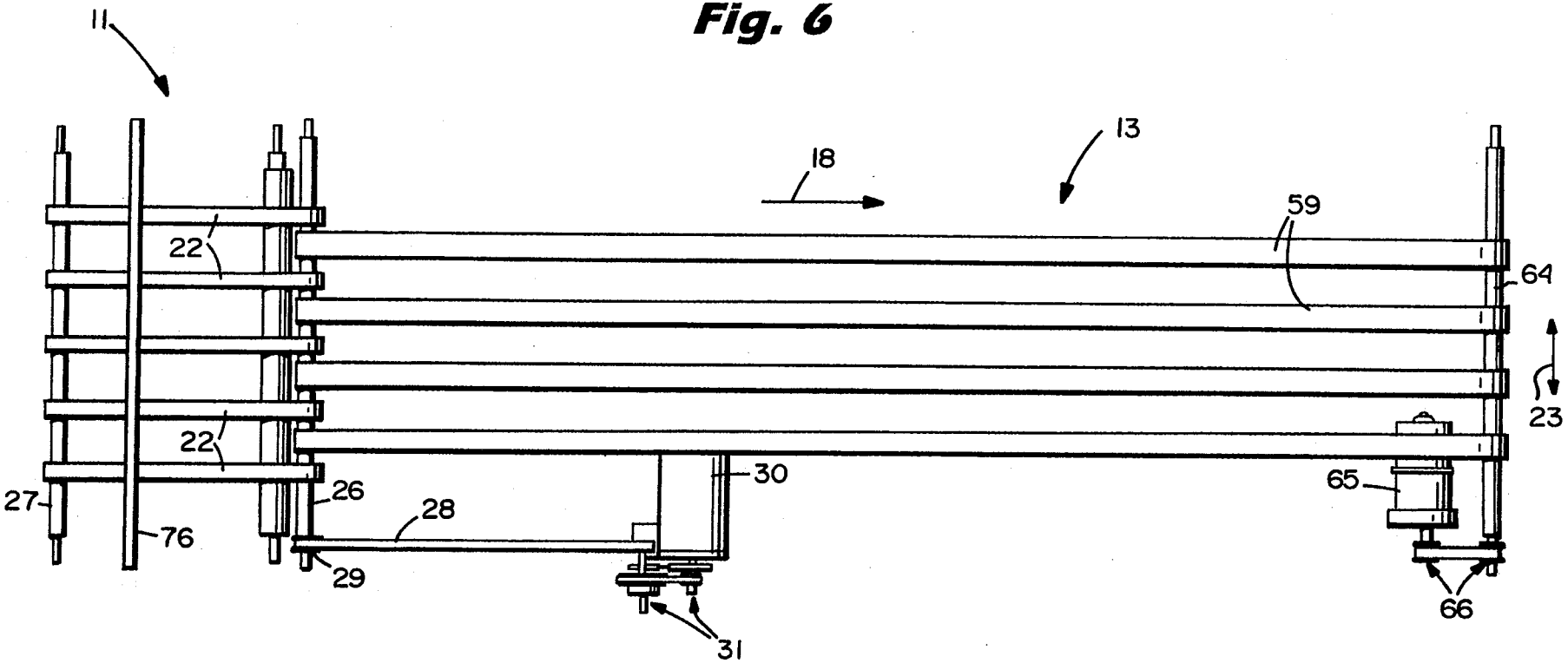
FIG. 6 is a view like that of FIG. 5 only just showing the drive components associated with the first and second conveyors and deflecting roller.

The first conveying means 11 according to the present invention are perhaps seen most clearly in FIGS. 2, 3, and 6 and comprise at least one, and preferably a plurality of, conveyor belts 22. As seen most clearly in FIG. 6, the conveyor belts 22 are parallel to each other and spaced from each other in a second horizontal dimension 23 transverse to the first direction 18.. The forms 17 are supported on the top surface of the belts 22, and preferably pass beneath a plurality of in-feed nip wheels 24 (see FIGS. 3 and 4) mounted for rotation about individual shafts 25 (see FIGS. 3 and 4 in particular) which properly position the forms 17 to be conveyed in the direction 18 by the first conveyor 11. The first conveying means 11 also comprises a first end roller 26, and a second end roller 27. The belts 22 are wrapped around the rollers 26, 27. Preferably the roller 26 is a driven roller, being driven by belt 28 which engages the pulley 29 mounted for rotation with the roller 26, the belt 28 being driven by an electric motor 30 through a gearing mechanism 31 (see FIG. 6). Alternatively, as illustrated in FIG. 2, a deflecting roller 33 may be driven instead by the motor 30, as illustrated belt 34 in FIG. 2. As seen in the drawings, the axes of rotation for the rollers or wheels 24, 26, 27, and 33 are all parallel to each other, and generally horizontal (extending in dimension 23).

The second conveying means 12, is perhaps seen most clearly in FIGS. 2 through 5. The second conveying means 12 preferably comprises a drive roller 35 (see FIGS. 2 and 3) rotatable about an axis of rotation 36, defined by the shaft 37 (see FIG. 4). It is also the axis 36 about which the second conveying means 12 pivots, as indicated by the arrow 38 in FIGS. 2 and 4. In greatly exaggerated form, FIG. 4 shows in dotted line the second conveying means pivoting about the axis 36 in response to a packing force being applied to the stacked forms 20, the packing force increasing as forms are fed into the stack 20 if the back stop 39 is held stationary.

The shaft 37 passes through two side plates forming the unit 12, the near side plate indicated by reference numeral 40 in FIG. 4, and the far side plate by reference numeral 41 in FIG. 3. Also extending between the plates 40, 41 are a first idler roller 42 (see FIG. 3), and a second idler roller 43. The axes of rotation of the rollers 42, 43 are parallel to the axis 36, the rollers 42, 43 are both downstream of the drive roller 35 in the first direction 18, and the axes of rollers 42, 43 are both vertically above the axis 36. The second conveying means 12 is constructed so that the center of gravity thereof, represented schematically at 44 in FIGS. 3 and 4, is downstream of the axis 36 in the direction 18, and also vertically above the axis 36. By providing the center of gravity 44 in this manner, and also mounting the unit 12 so that it pivots about the axis 36, the weight of the unit 12 will apply a packing force component in the direction 18 against the forms 17 in the stack 20.

According to one aspect of the present invention, the pivot axis 36 is stationary. That is the shaft 37 is mounted within an opening 46 (shown by dotted line in FIG. 4) which is part of the side frame plate 47 (also shown in dotted line for the portion thereof which contains the opening 46, in FIG. 4). Obviously plates 47 are provided on both sides of the conveying unit 12, as seen in FIG. 5, receiving the shaft 37 therein.

The conveying means 12 also comprises at least one and preferably a plurality of conveyor belts 48 (see FIGS. 2, 3, and 5), preferably a plurality of belts 48 being provided spaced from each other in the second dimension 23. The belts 48 are driven, as illustrated by arrow 19 in FIGS. 2 and 3, so as to convey forms engaged thereby vertically upwardly, so that they assume the vertical orientation of the forms 17 in the stack 20 seen in FIGS. 3 and 4.

The belts 48 are driven in the direction indicated by arrow 19 preferably by the drive gear 49 connected to the drive roller 35. In the exemplary embodiment illustrated in FIG. 3, the drive gear 49 intermeshes with the drive gear 50 associated with the deflecting roller 33. The deflecting roller 33 may either be driven directly by the belt 34, as illustrated in FIG. 2, or indirectly by the roller 26 being driven by pulley 29 and belt 28, this driving action being translated into rotation of both of the rollers 33, 35, and gears 49, 50 associated therewith, by frictional engagement between the belts 22, 48, in the particular positions and deflections that they have as illustrated in FIG. 3.

The second conveying means 12 also preferably comprises an adjustable form depth stop best seen in FIGS. 2, 3, and 5, and shown generally by reference numeral 51. The form depth stop 51 has a horizontally extending top portion 52 thereof (see FIGS. 2, 3, and 5) that engages the tops of the forms 17 in the stack 20, providing a limit as to how far the belts 48 may vertically convey the forms 17. The depth stop 51 also preferably has a vertical portion 53 which has a vertically elongated slot 54 (see FIG. 3) therein which receives the shaft of a thumb screw 55. The shaft 56 of the thumb screw 55 is in threaded engagement with the cross member 57 of the second conveying means 12 extending between the plates 40, 41 (parallel to the axis 36). By loosening the thumb screw 55 the position of the top horizontal portion 52 of the forms stop 51 may be adjusted to accommodate forms 17 of different depths. Once the surface 52 is moved to the desired position (the spacing thereof from belts 22 equal to the depth of the forms 17 being handled), the thumb screw 55 is tightened so that the depth stop 51 is maintained in place. Note that the horizontally extending portion 52 extends horizontally outwardly from the belts 48 in the first direction 18 as seen in FIG. 5. While only one form depth stop 51 need be provided, as shown in FIG. 5 preferably a plurality thereof are provided (e.g. four, extending between each of the five belts 48).

The deflecting means 14 includes the deflecting roller 33, as well as the particular positioning of that roller 33 with respect to the rollers 35, 42 as illustrated in FIGS. 2 and 3. Forms 17 which pass between the belts 22, 48, being conveyed thereby, are deflected upwardly toward the direction 19 by the belts 22, 48 due to the deflection thereof by the deflecting roller 33, and then continue upwardly in direction 19 driven by the belts 48.

The third conveyor means 13 preferably includes a table top 58 (FIGS. 1 and 5) on which the back stop 39 is mounted, as well as a plurality of third endless conveyor belts 59 (e.g. three or four belts spaced from each other in the second direction 23) which are adapted to be intermittently driven in the direction 18. The table top 58 may be mounted at the end thereof remote from the second conveying means 12 by the legs 60 with castors 61 at the bottom thereof (see FIG. 1), and at the inlet end thereof by a detacher 62 or like conventional piece of business forms handling equipment.

Figure 8:
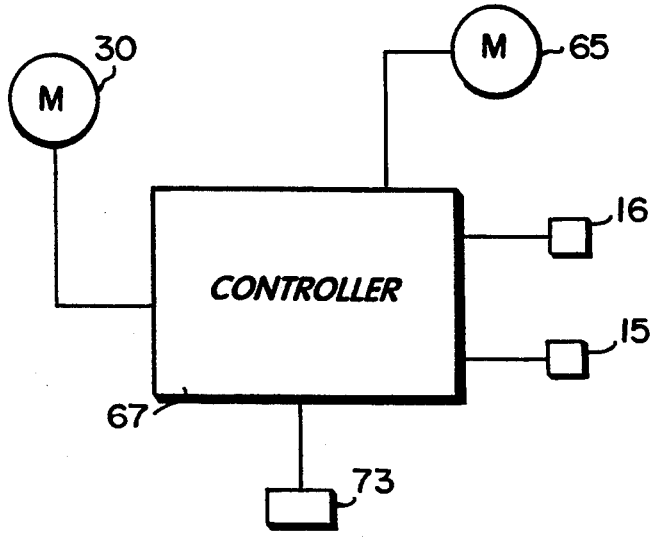
FIG. 8 is a control schematic for the apparatus of FIGS. 1 through 6.

The belts 59 are wrapped around the roller 26 at the left, inlet, end thereof as seen in FIGS. 2 and 3, and at the remote end thereof around the drive roller 64 (see FIGS. 2, 5, and 6). Since obviously it is undesirable to drive the belts 59 at the same time that the belts 22 are driven, at least on a regular basis, while the belts 59 are interleaved (see FIG. 6) with the belts 22 on the roller 26, they are not driven with the roller 26, but rather are mounted on sleeves which have a slip engagement with the roller 26. The belts 59 are driven intermittently in direction 18 when the electric motor 65 (see FIGS. 2, 6, and 8) is activated, typically being driven through a belt and pulley arrangement shown generally by reference numeral 66 in FIGS. 2 and 6. A computer controller 67 (see FIG. 8) or the like is utilized to control the motor 65 so that it is only operated for a short period of time when activated, so that it moves the back stop 39 in the direction 18 a short distance to relieve the packing force on the forms 17 in the stack 20. The back stop 39, which is in good frictional engagement with the belts 59, as well as possibly directly engaging the table 58 at portions thereof, moves with the belts 59, the belts 59 simultaneously conveying the forms 17 in the stack 20 when moved in the direction 18.

In order to effect intermittent operation of the motor 65, the first sensing means 15 (see FIGS. 2, 4, and 8) is provided. While any suitable type of sensor may be utilized, the sensor 15 preferably is a thru-beam sensor, such as Honeywell PT#HOA 1881. As seen schematically in FIG. 4, the sensor 15 may be mounted on an arm 69 whose position in the direction 18 may be adjusted along the slot 70 in the arm 69 utilizing the thumb screw adjustment 71. The sensor 15 is connected to the controller 67 (see FIG. 8) so that when the second conveyor means 12 pivots counterclockwise about the axis 36 a predetermined amount (e.g. as indicated in dotted line in FIG. 4, although FIG. 4 greatly exaggerates the amount of movement that typically would be accommodated before the sensor 15 would activate it, for clarity of illustration) it signals the controller 67, which then controls the motor 65. After movement of conveyor means back to its solid line position in FIG. 4 (which naturally occurs when the packing force is relieved by movement of stack 20 in direction 18), the sensor 15 signals the controller 67 to turn motor 65 off.

The second sensor 16 (see FIGS. 2 and 8) also preferably is provided to shut down the stacking apparatus 10 once a complete stack 20 has been formed. The sensor 16 may be of any operable type, such as a reflective object sensor like that provided by TRW, #OPB706. It senses when the back stop 39 has moved over it, and then shuts down the motors 30 and 65 (by signalling the controller 67) so that the operator knows to remove the stack, and reposition the back stop 39 (to the position illustrated in FIG. 2) before operating an appropriate switch (e.g. 73 in FIG. 8) for starting the motor 30 again.

Various other features may also be provided if desired. For example:

The infeed nip rolls 24 may be mounted on arms 75 for rotation about the shaft 76, as seen in FIGS. 3 through 6.

Stops may be provided for limiting the pivotal movement of the second conveying means 12 in the arc indicated by arrows 38. FIG. 4 schematically illustrates a first stop means (a simple metal abutment attached to the frame 47 for engaging plate 40, for example) 78 which prevents movement of the second conveying means 12 to a position in which the center of gravity 44 would be on the upstream side of axis 36 in the direction 18, e.g. if the sensor does not operate properly, or when the machine is off. The stop 79 is provided to prevent the second conveying means 12 from "falling" should the apparatus 10 be partially disassembled. Normally, some portion of the second conveying means 12, typically the conveyors belts 48, will engage the stack 20 or the back stop 39 to provide a stop, the stop 79 being provided only for unusual situations.

Figure 7:
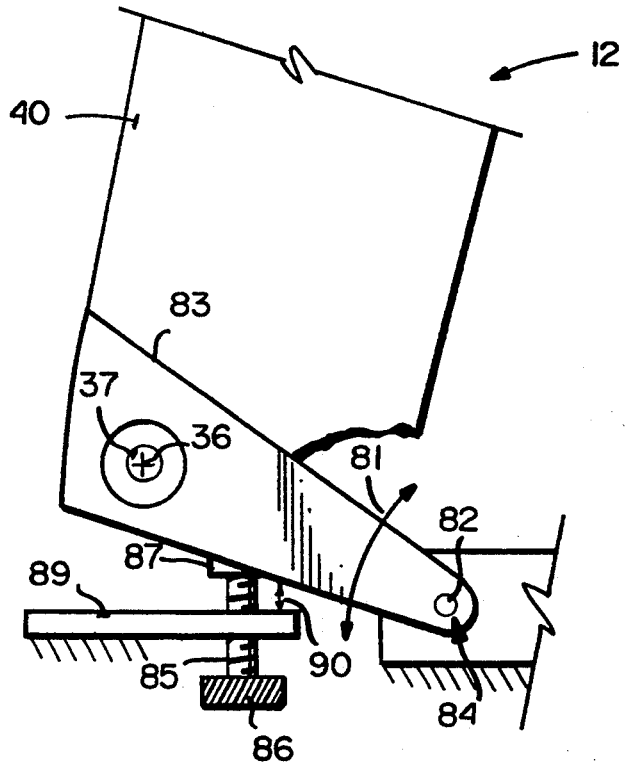
FIG. 7 is a schematic detailed side view showing an exemplary mechanism for mounting the second conveying means so that the horizontal axis about which it is pivotable may be adjusted.

Also, according to another aspect of the present invention the position of the axis 36 may be adjusted to allow positioning of the center of gravity 44 to provide a variable packing force on the stack 20, or to ensure proper deflection and conveyance of the forms 17 if they have varying thickness, or stiffness. While any suitable means may be utilized, a means will be particularly described with respect to FIGS. 3 and 7 which provides for movement of the axis 36 only along a circular arc 81, the center of the circular arc 81 being the center 82 of the roller 33 (i.e. its axis of rotation). As seen in FIG. 7, a mounting bracket 83 (one would be provided on each side of the second conveying means 12) receives the shaft 37 therein, the arm 83 pivoted about a pivot pin 84 along the axis 82. An externally screw threaded bolt 85, having a thumb screw head actuator 86, engages an abutment portion 87 of the arm 83, and is received within a stationarily mounted plate 89. By rotating the screw 85, it will move up and down in direction 90, therefore it will push the arm 83 (and thus the second conveying means 12) up, or allow it to move downwardly, thereby adjusting the position of the axis 36 along a circular arc 81.

While the apparatus 10 may be used for almost any type of flexible planar article, it is particularly useful for business forms having a substantially uniform depth of between about three to six inches, with a multi-ply configuration. According to this aspect of the invention, the multi-ply business forms 17 are conveyed in the first generally horizontal direction 18 (e.g. by conveying means 11) and then are deflected, in sequence, so that the leading edges thereof move upwardly in the direction 19 (by the belts 22, 48 at the area between the rollers 35, 33). Substantially simultaneously with and subsequent to the deflection of the forms 17, they are driven (by belts 48) vertically upwardly in the direction 19 so that the depths thereof extend generally vertically (see the stack 20 in FIGS. 1, 3, and 4). Then substantially simultaneously with, and subsequent to, the vertical conveyance thereof, the forms are stacked, the first form in the stack engaging the back stop 39. Simultaneously with the stacking action, the bias of a force component of the weight of the second conveying means 12 pivoting about the axis 36 is provided against the vertically oriented forms 17 so as to facilitate packing of the forms in the stack. Once the packing force on the stack reaches a predetermined level (which causes the second conveying means 12 to move counterclockwise in the arc 38), the back stop 39 is intermittently activated to move it in the direction 18 a distance sufficient to reduce the packing force on the stack 20. That is the sensor 15 senses the pivotal movement of the second conveying means 12 counterclockwise, then through the controller 67 intermittently operates the motor 65 to move the back stop in direction 18 until the conveying means 12 moves back clockwise, so that it is no longer sensed by the sensor 15. Then, once the stack 20 of sufficient size has been formed so that back stop 39 is sensed by the sensor 16, the entire apparatus 10 is shut down until the stack 20 is removed and the back stop 39 returned to its initial position (that of FIG. 2).

It will thus be seen that according to the present invention an advantageous method and apparatus for stacking of planar articles, particularly business forms, having a vertical orientation in a horizontally elongated stack, have been provided. While the invention has been herein shown and described in what is presently conceived to be the most practical and preferred embodiment thereof it will be apparent to those of ordinary skill in the art that many modifications may be made thereof within the scope of the invention, which scope is to be accorded broadest interpretation of the appended claims so as to encompass all equivalent structures and processes.

What is claimed is:

1. A stacking apparatus comprising:

first conveying means for conveying generally planar articles to be stacked in a first, substantially horizontal direction;

deflecting means for deflecting articles conveyed by said first conveying means toward a generally vertical orientation;

a backstop for articles disposed in a generally vertical orientation;

second conveying means for conveying articles generally vertically from said deflecting means into a generally vertical orientation in operative association with said backstop;

means for mounting said second conveying means for pivotal movement about a generally horizontal axis;

third conveying means associated with said backstop for moving said backstop, and generally vertically orientated articles stacked in association therewith, away from said second conveying means in said first direction;

first sensing means for sensing pivotal movement of said second conveying means about said generally horizontal axis; and means for effecting intermittent operation of said third conveying means in response to said sensing means sensing pivotal movement of said second conveying means.

2. Apparatus as recited in claim 1 further comprising an article depth stop mounted adjacent said second conveying means for limiting the generally vertical movement of articles by said second conveying means.

3. Apparatus as recited in claim 2 further comprising means for adjustably mounting said article depth stop so that said depth stop may be adjusted to accommodate articles of different depths.

4. Apparatus a recited in claim 1 further comprising a plurality of infeed nip wheels mounted in operative association with said first conveying means, upstream of said second conveying means in said first direction, for properly positioning articles to be conveyed on said first conveying means.

5. Apparatus as recited in claim 1 wherein said first conveying means comprise a plurality of first conveyor belts spaced from each other in a second generally horizontal direction, transverse to said first direction; and wherein said deflecting means includes a deflecting roller over which said first conveyor belts pass.

6. Apparatus as recited in claim 5 wherein said second conveying means comprise a plurality of second conveyor belts spaced from each other in said second direction and passing over a drive roller, and first and second idler rollers, said drive roller having a bottom peripheral surface portion vertically below and upstream, in said first direction, of a top peripheral surface of said deflecting roller, and said first idler roller having a bottom peripheral surface vertically above said top peripheral surface of said deflecting roller, and the axis of rotation of said first idler roller being slightly downstream of the axis of rotation of said deflecting roller in said first direction; said drive roller of said second conveying means cooperating with said first idler roller, said first conveyor belts, and said deflecting roller to provide said deflecting means.

7. Apparatus as recited in claim 6 wherein said second conveying means drive roller and said deflecting roller have intermeshing gears associated therewith so that driving of one of said drive roller and deflecting roller results in driving of the other.

8. Apparatus as recited in claim 7 wherein said means for mounting said second conveying means for pivotal movement about a generally horizontal axis comprises a shaft connected to said drive roller, and bearing means for mounting said shaft so that it defines a generally horizontal axis about which said second conveying means may pivot, said bearing means including first and second plates spaced from each other in said second direction and mounting all of said drive and idler rollers of said second conveying means.

9. Apparatus as recited in claim 8 further comprising means for adjusting the position of the pivot point about which said second conveying means pivots, while still retaining said gears of said second conveying means drive roller and said deflecting roller in intermeshing engagement with each other.

10. Apparatus as recited in claim 6 wherein said first conveying means includes a first end roller about which said first conveyor belts are wrapped disposed at roughly the same vertical position as said deflecting roller and downstream thereof in said first direction, said first end roller positioned so that said first conveyor belts convey articles in said first direction a short distance after they are stacked in said vertical orientation.

11. Apparatus as recited in claim 10 wherein said third conveying means comprises a plurality of third conveyor belts spaced from each other in said second direction, and wherein said first and third conveyor belts are wrapped about said first end roller in interleaved relationship.

12. Apparatus as recited in claim 11 wherein said third conveying means further comprises a generally horizontal table surface over which said third conveyor belts and said backstop pass.

13. Apparatus as recited in claim 6 wherein said means for mounting said second conveying means for pivotal movement about a generally horizontal axis comprises a shaft connected to said drive roller, and bearing means for mounting said shaft so that it defines a generally horizontal axis about which said second conveying means may pivot, said bearing means including first and second plates spaced from each other in said second direction and mounting all of said drive and idler rollers of said second conveying means.

14. Apparatus as recited in claim 13 wherein said second conveying means has a center of gravity, and further comprising stop means for limiting the pivotal movement of said second conveying means away from said backstop so that the center of gravity of said second conveying means is always between said generally horizontal pivot axis thereof and said backstop, and so that a force component of the weight of said second conveying means biases articles being stacked into said vertical orientation in operative association with said backstop.

15. Apparatus as recited in claim 1 wherein said second conveying means has a center of gravity, and further comprising stop means for limiting the pivotal movement of said second conveying means away from said backstop so that the center of gravity of said second conveying means is always between said generally horizontal pivot axis thereof and said backstop, and so that a force component of the weight of said second conveying means biases articles being stacked into said vertical orientation in operative association with said backstop.

16. Apparatus as recited in claim 1 wherein said second conveying means has a center of gravity, and further comprising means for adjusting the position of the pivot point about which said second conveying means pivots so as to adjust the position of the center of gravity of said second conveying means with respect to said backstop.

17. Apparatus as recited in claim 1 further comprising second sensing means mounted in association with said third conveying means at a point thereof remote from said second conveying means, said second sensing means for sensing the position of said backstop and for terminating operation of said first, second and third conveying means once said backstop reaches a predetermined position remote from said second conveying means.

18. A method of stacking a plurality of multi-ply business forms having a substantially uniform depth, so that the depths of the forms extend in a generally vertical orientation, utilizing a backstop capable for generally horizontal movement, said method comprising the steps of substantially sequentially:

(a) conveying the multi-ply business forms having a substantially uniform depth in sequence in a first generally horizontal direction, the forms each having a leading edge in the first direction;

(b) deflecting the forms, in sequence, so that the leading edges thereof move upwardly;

(c) substantially simultaneously with, and subsequent to, step (b), driving the forms so that they move upwardly and assume a vertical orientation, the depths thereof extending generally vertically;

(d) substantially simultaneously with, and subsequent to, step (c) stacking the forms in a horizontally elongated stack, the first form in the stack engaging the backstop; and substantially simultaneously with steps (c) and (d), (e) applying the bias of a horizontal force component of a weight against the vertically oriented forms so as to facilitate packing of the forms, in a stack, the weight horizontal force component compressing the forms in the stack while the backstop is stationary.

19. A method as recited in claim 18 comprising the further step (f) of intermittently, in response to the horizontal packing force on the stack reaching a predetermined level, moving the backstop in the first direction a distance sufficient to reduce the packing force on the stack.

20. A method as recited in claim 19 comprising the further step (g) of automatically terminating steps (a)–(f) once the stack of forms has reached a predetermined size.

21. A method as recited in claim 20 comprising the further step (h) of limiting the upward movement of the forms in the practice of step (b).

22. A method as recited in claim 18 comprising the further step (f) of limiting the upward movement of the forms in the practice of step (b).

23. A method as recited in claim 22 comprising the further step (g) of, prior to the practice of steps (a)–(f), depending upon the depth of the forms being acted upon, adjusting the position to which upward movement of the forms during the practice of step (b) will be limited.

24. A method as recited in claim 18 wherein steps (a) through (e) are practiced utilizing multi-ply business forms having a substantially uniform depth of about 3–6 inches.

25. A method of stacking a plurality of planar articles using a backstop movable in a generally horizontal first direction, so that the articles have a generally vertical orientation, said method comprising the steps of:

(a) conveying the articles, in sequence, in the first direction, each article having a leading edge in the first direction;

(b) deflecting the articles, in sequence, so that the leading edges thereof move vertically upwardly;

(c) substantially simultaneously with, and subsequent to, step (b), conveying the articles vertically upwardly so that they assume a vertical orientation;

(d) substantially simultaneously with step (c), forming the articles into a horizontally elongated stack while they have a vertical orientation; and (e) substantially simultaneously with steps (b) and (c), applying a horizontal force component of a weight against the articles in the stack so as to facilitate packing of the articles in the stack, the horizontal force component of the weight compressing the articles in the stack while the backstop is held stationary.

26. A method as recited in claim 25 comprising the further step (f) of intermittently, in response to the packing force on the stack reaching a predetermined level, moving the backstop in the first direction a distance sufficient to reduce the packing force on the stack.

27. A method as recited in claim 26 wherein the articles are business forms, and comprising the further step (g) of automatically terminating steps (a)–(f) once the stack of forms has reached a predetermined size.

28. A method as recited in claim 26 comprising the further step of automatically terminating steps (a) through (f) once the stack of articles has reached a predetermined size.

29. A method as recited in claim 25 comprising the further step of, prior to the practice of steps (a) through (e), depending upon the depth of the forms being acted upon, adjusting the position to which upward movement of the forms during the practice of step (b) will be limited.

30. A method of stacking a plurality of planar articles using a backstop movable in a generally horizontal first direction, so that the articles have a generally vertical orientation, said method comprising the steps of:

(a) conveying the articles, in sequence, in the first direction, each article having a leading edge in the first direction;

(b) deflecting the articles, in sequence, so that the leading edges thereof move vertically upwardly;

(c) substantially simultaneously with, and subsequent to, step (b), conveying the articles vertically upwardly so that they assume a vertical orientation;

(d) substantially simultaneously with step (c), forming the articles into a horizontally elongated stack while they have a vertical orientation; and (e) intermittently moving the backstop in the first direction so that stacking proceeds continuously and so that a horizontal packing force is applied to the articles in the stack.

31. A method as recited in claim 30 comprising the further step of automatically terminating steps (a) through (e) once the stack of articles has reached a predetermined size.

* * * * *